US012281439B2

(12) United States Patent
Loijas et al.

(10) Patent No.: US 12,281,439 B2
(45) Date of Patent: Apr. 22, 2025

(54) BLADE SEGMENT FOR REFINER

(71) Applicant: Valmet Technologies Oy, Espoo (FI)

(72) Inventors: Marko Loijas, Valkeakoski (FI); Tomi Iisakkila, Valkeakoski (FI)

(73) Assignee: Valmet Technologies Oy, Espoo (FI)

( * ) Notice: Subject to any disclaimer, the term of this patent is extended or adjusted under 35 U.S.C. 154(b) by 396 days.

(21) Appl. No.: 18/008,625

(22) PCT Filed: Jun. 3, 2021

(86) PCT No.: PCT/FI2021/050413
§ 371 (c)(1),
(2) Date: Dec. 6, 2022

(87) PCT Pub. No.: WO2021/250315
PCT Pub. Date: Dec. 16, 2021

(65) Prior Publication Data

US 2023/0220624 A1 Jul. 13, 2023

(30) Foreign Application Priority Data

Jun. 8, 2020 (FI) ..... 20205590

(51) Int. Cl.
*D21D 1/30* (2006.01)

(52) U.S. Cl.
CPC ..... *D21D 1/306* (2013.01)

(58) Field of Classification Search
CPC ..... B02C 15/003; B02C 18/365; B02C 7/12; D21D 1/30; D21D 1/303; D21D 1/306
See application file for complete search history.

(56) References Cited

U.S. PATENT DOCUMENTS

2014/0110511 A1* 4/2014 Antensteiner ..... D21D 1/306 241/261.3
2024/0263395 A1* 8/2024 Ruola ..... D21D 1/306

FOREIGN PATENT DOCUMENTS

EP 2326767 B1 2/2016
EP 3401439 A1 * 11/2018 ..... B02C 18/14
EP 3401439 B1 10/2019
WO WO-2010106225 A1 * 9/2010 ..... B02C 7/12
WO WO-2015133962 A1 * 9/2015 ..... B02C 7/02

OTHER PUBLICATIONS

International Search Report for PCT/FI2021/050413 dated Sep. 2, 2021.
Written Opinion of the International Searching Authority for PCT/FI2021/050413 dated Sep. 2, 2021.

* cited by examiner

*Primary Examiner* — Bobby Yeonjin Kim
(74) *Attorney, Agent, or Firm* — Stiennon & Stiennon

(57) ABSTRACT

A blade segment (4, 8) for a refiner (1) for refining fibrous material has a first (20) and a second (21) end edge and a first (22) and a second (23) side edge opposite to the first side edge (22) and a refining surface (5, 9) having blade bars (27, 27*a*, 27*b*) and grooves (28, 28*a*, 28*b*) therebetween on a front surface (25). At least one opening (14, 15) is on at least at one side edge (22, 23) which extends through the whole thickness of the blade segment body (24). There is at least one feed groove (29) on the refining surface, the feed groove (29) extending from the opening and crossing the blade bars and the blade grooves for feeding the material to be refined across the refining surface. The blade bars (27, 27*a*, 27*b*) of the blade segment are interlaced at the feed groove.

20 Claims, 3 Drawing Sheets

BLADE SEGMENT FOR REFINER

CROSS REFERENCES TO RELATED APPLICATIONS

This application is a U.S. national phase application for PCT/FI2021/050413 and claims priority on FI20205590, filed Jun. 8, 2020, the disclosures of which are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to refiners for refining fibrous material and especially to a blade segment for a refiner for refining fibrous material.

Refiners used for refining fibrous material, such as refiners used for manufacturing mechanical pulp or in any low consistency refining, comprise typically two refining elements opposite to each other forming a refining gap or a refining chamber therebetween and turning relative to each other, i.e., one or both of them is/are rotating. The refining elements comprise refining surfaces provided with blade bars and blade grooves therebetween, the blade bars being intended to defiber and refine the material to be refined and the blade grooves being intended to convey the material to be refined forward along the refining surfaces. The refining surface of the refining element is typically formed of several blade segments fastened to a body of the respective refining element. The complete refining surface of the refining element is thus formed of the refining surfaces of several blade segments fastened next to each other in the refining element.

One type of refiner is a so-called through-fed or through-flow refiner in which the material to be refined is fed to the refining gap not just from one end towards the other end of the refiner but from the middle, too, in other words, through the refining element(s). This type of refiner is disclosed in EP 2326767 B1 where the refining element comprises openings providing open area of 5-70% of its refining area. Another example is disclosed in EP 3401439 B1 in which the openings are indents on a side edge of the refining segment and the material flow is enhanced by feed grooves.

SUMMARY OF THE INVENTION

An object of the present invention is to provide a novel blade segment for a refiner for refilling fibrous material, as well as a novel refiner for refining fibrous material.

The invention is based on the idea of interlacing the blade bars of the blade segment at the feed groove.

The interlacing of the blade bars at the feed groove provides at the feed groove a strong blade bar configuration wherein the interlaced blade bars support each other, thereby preventing a buckling of the blade bars at the feed groove.

BRIEF DESCRIPTION OF THE DRAWINGS

For the sake of clarity, the figures show some embodiments of the invention in a simplified manner. Like reference numerals identify like elements in the figures.

DESCRIPTION OF THE PREFERRED EMBODIMENTS

Figure 1:
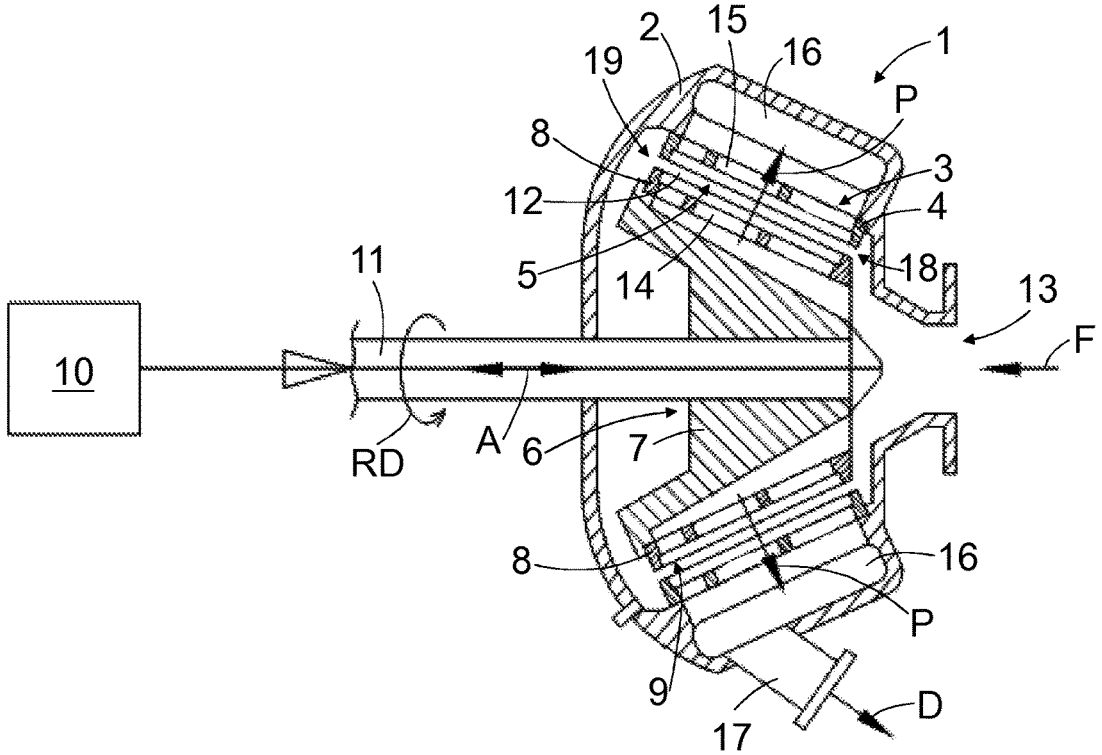
FIG. 1 is a schematic general side view of a conical refiner in cross-section.

FIG. 1 is a schematic general side view of a general construction of a refiner 1 in cross-section, which refiner may be used for refining a fibrous material, such as a wood material containing lignocellulose or another fiber material suitable to be used for manufacturing paper or paperboard, for example. The refiner 1 shown in FIG. 1 is of conical type but disc-refiners, conical-disc-refiners and cylindrical refiners could be used as well as an example here. Generally, a refiner comprises at least two substantially oppositely positioned refining elements at least one of which is rotating, and a refining chamber formed between each two substantially oppositely positioned refining elements. In the following a refiner with only one rotatable refining element is described.

The refiner 1 of FIG. 1 comprises a frame 2 and a stationary, fixed refining element 3, i.e., a stator 3, supported on the frame 2. The stator 3 comprises two or more stator blade segments 4, each of them comprising blade bars and blade grooves therebetween. The blade bars and the blade grooves in each stator blade segment 4 form a refining surface 5 of the respective blade segment 4, the refining surface 5 of each stator blade segment 4 thereby providing a part of a refining surface of the stator 3. A complete refining surface of the stator 3 is formed of the refining surfaces 5 of a necessary number of the blade segments 4 fastened next to each other in the stator 3 so that the complete refining surface 5 extending over the whole circumference of the stator 3 is provided. For the sake of clarity, both the refining surface of each single stator blade segment 4 as well as the complete refining surface of the stator 3 are herein denoted with the same reference sign 5.

The refiner 1 further comprises a rotatable refining element 6, i.e., a rotor 6, of the refiner 1. The rotor 6 comprises a hub 7. The rotor 6 further comprises two or more rotor blade segments 8 supported to the hub 7, each rotor blade segment 8 comprising blade bars and blade grooves therebetween. The blade bars and the blade grooves in each rotor blade segment 8 form a refining surface 9 of the respective blade segment 8, the refining surface 9 of each rotor blade segment 8 thereby providing a part of a refining surface of the rotor 6. A complete refining surface of the rotor 6 is formed of the refining surfaces 9 of a necessary number of the blade segments 8 fastened next to each other in the rotor 6 so that the complete refining surface 9 extending over the whole circumference of the rotor 6 is provided. For the sake of clarity, both the refining surface of each single rotor blade segment 8 as well as the complete refining surface of the rotor 6 are herein denoted with the same reference sign 9.

The hub 7 of the rotor 6 is connected to a driving motor 10 by a shaft 11 so that the rotor 6 can be rotated relative to the stator 3 in a direction of arrow RD, for instance, the arrow RD thus indicating an intended rotation direction RD of the rotor 6.

The refiner 1 may also comprise a loading device which, for the sake of clarity, is not shown in FIG. 1. The loading device can be used for moving back and forth the rotor 6 attached to the shaft 11, as schematically shown by arrow A, in order to adjust a size of a refining gap 12, i.e., a refining chamber 12, between the stator 3 and the rotor 6, wherein the fibrous material is actually refined.

The fibrous material to be refined is fed into the refiner 1 via a feed channel 13 in a manner shown by arrow F. In one embodiment most of the fibrous material fed into the refiner 1 passes, in a manner schematically shown by arrows P, through openings 14 formed in the rotor blade segments 8 into the refining chamber 12, wherein the fibrous material is to be refined. Furthermore, most of the already refined fibrous material is, in turn, discharged through openings 15 formed in the stator blade segments 4 into an intermediate space 16 between the frame 2 of the refiner 1 and the stator 3, wherefrom the refined material is removed via a discharge channel 17 from the refiner 1, as schematically shown by arrow D.

Since the space between the rotor 6 and the frame 2 of the refiner 1 of FIG. 1 is not fully closed, some of the fibrous material to be fed into the refiner 1 may transfer into the refining chamber 12 from the right end of the refining chamber 12, i.e., from a first end 18 or an inner end 18 of the refiner 1 having a smaller diameter, as seen in FIG. 1. Correspondingly, some of the already refined material may also exit the refining chamber 12 from the left end of the refining chamber 12, i.e., from a second end 19 or an outer end 19 of the refiner 1 having a larger diameter, as seen in FIG. 1, wherefrom a connection is provided to the intermediate space 16.

In the embodiment of FIG. 1 of the refiner 1, only one feed channel 13 is provided, and it is arranged at the first end 18 of the refiner 1 having the smaller diameter. The actual implementation of the refiner could also comprise a second feed channel arranged at the second end 19 of the refiner 1 having the larger diameter, whereby the discharge channel 17 of the refiner 1 could be arranged for example somewhere between the first 18 and second 19 ends of the refiner 1. In the following, the reference sign 18 and the term first end 18 or the term inner end 18 may indicate both the first end 18 or the inner end 18 of the refiner 1 having the smaller diameter and the first end 18 or the inner end 18 of the refining element 3, 6 or of the refining chamber 12 having the smaller diameter. Correspondingly, the reference sign 19 and the term second end 19 or the term outer end 19 may indicate both the second end 19 or the outer end 19 of the refiner 1 having the larger diameter and the second end 19 or the outer end 19 of the refining element 3, 6 or of the refining chamber 12 having the larger diameter.

It is emphasized that in addition to the conical refiner disclosed above the blade segment of the solution described herein may be applied in other kinds of conical refiners too. In addition to the conical refiners, the blade segment of the solution described herein is applicable to disc refiners and cylindrical refiners and to refiners comprising both a conical portion and a disc portion, as well.

Figure 2:
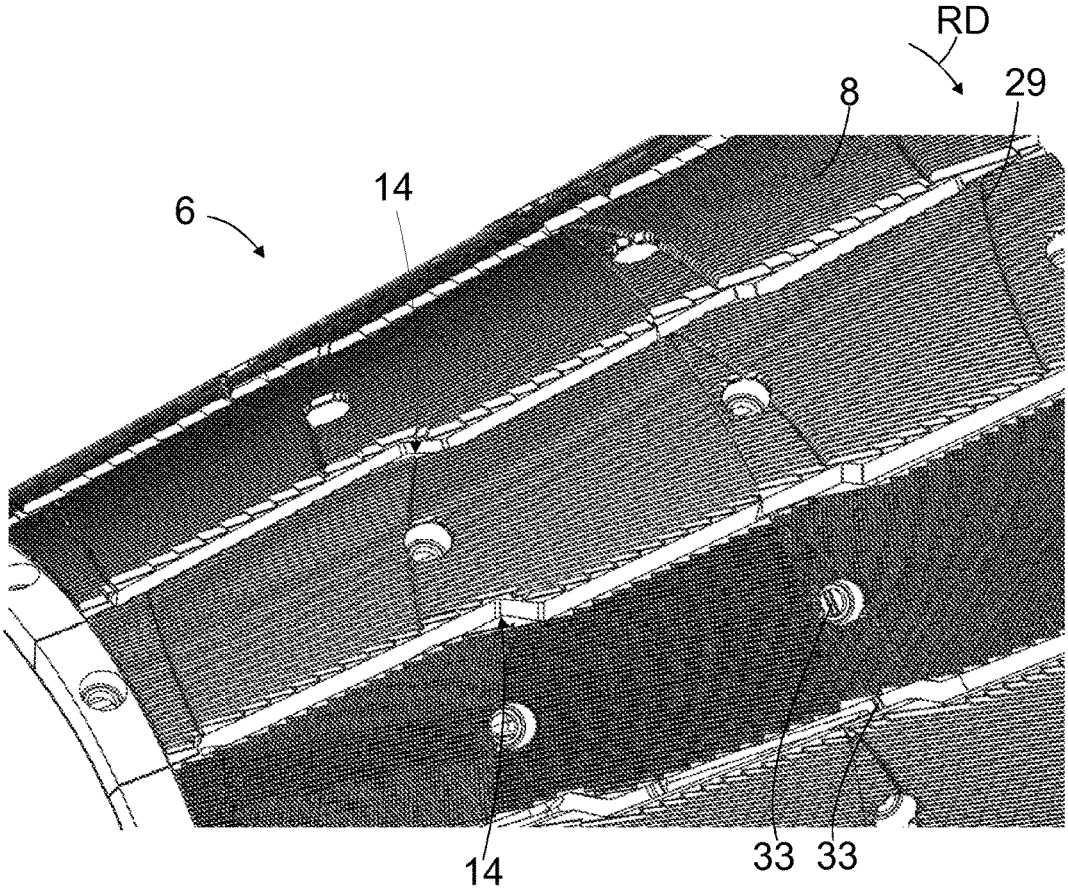
FIG. 2 is a schematic upper oblique view of a part of a set of neighboring rotor blade segments.
Figure 3:
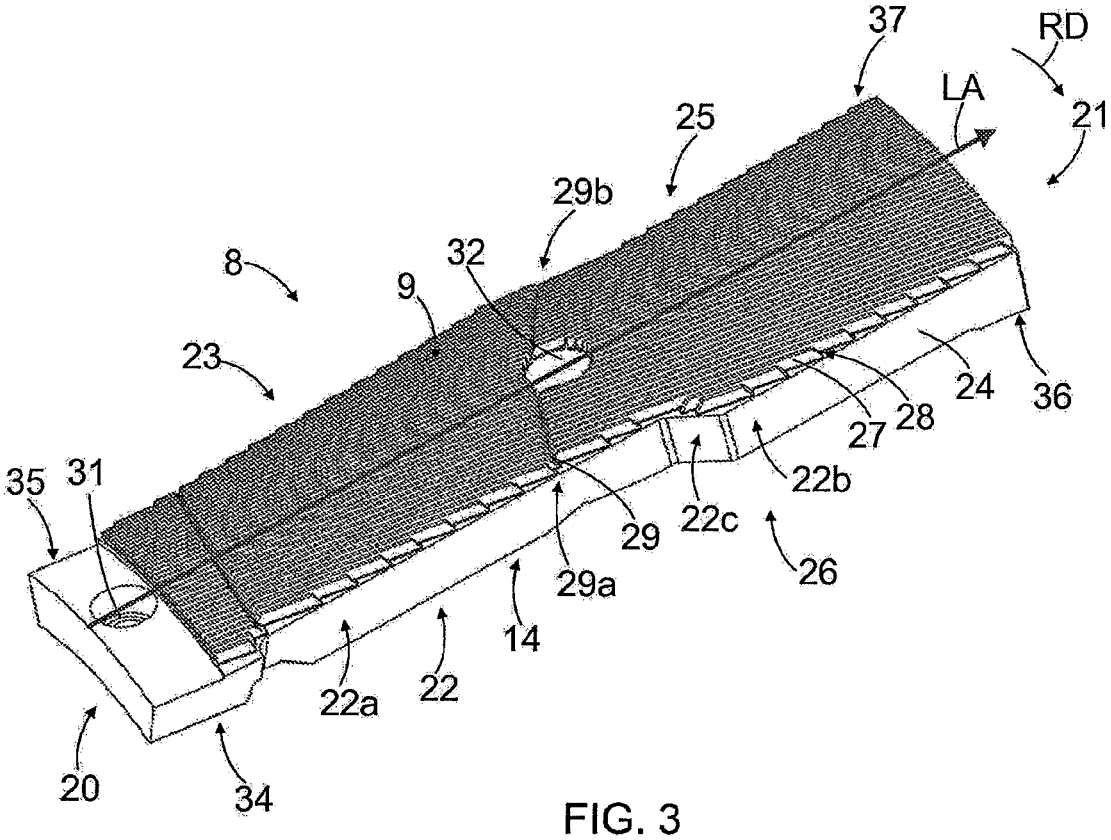
FIG. 3 is a schematic upper oblique view of a rotor blade segment.

FIG. 2 is a schematic upper oblique view of a part of a set of neighboring rotor blade segments 8 and FIG. 3 is a schematic upper oblique view of a rotor blade segment 8 applicable to be used for forming a part of the refining surface 9 of the rotor 6. In the following the blade segment structure is considered in more detail in view of the rotor blade segment 8 but the structure of the stator blade segment 4 is substantially similar unless otherwise disclosed.

The blade segment 8 comprises an inner end edge 20 or a first end edge 20 to be directed towards the inner end 18 of the rotor 6 having the smaller diameter. The blade segment 8 further comprises an outer end edge 21 or a second end edge 21 to be directed towards the outer end 19 of the rotor 6 having the larger diameter. In the conical and cylindrical refiners, the inner end edge of the blade segment provides an axially inner end of the blade segment and the outer end edge of the blade segment provides an axially outer end of the blade segment, the direction from the axially inner end towards the axially outer end providing the longitudinal axis of the blade segment, the longitudinal axis of the blade segment shown schematically in FIG. 3 by an arrow LA. In disc refiners the inner end edge of the blade segment would provide a radially inner end of the blade segment and the outer end edge of the blade segment would provide a radially outer end of the blade segment, the direction from the radially inner end towards the radially outer end thus providing the longitudinal axis of the blade segment.

The blade segment 8 further comprises a first side edge 22 or a leading side edge 22 extending from the inner end edge 20 of the blade segment 8 up to the outer end edge 21 of the blade segment 8 and providing the side edge of the blade segment 8 which is the first to meet an edge of a counter blade segment, thus it is directed towards the intended rotation direction RD of the rotor 6. The blade segment 8 further comprises a second side edge 23 or a trailing side edge 23 opposite to the first side edge 22 and extending from the inner end edge 20 of the blade segment 8 up to the outer end edge 21 of the blade segment 21 and providing the side edge of the blade segment 8 which is the last to meet an edge of a counter blade segment, thus it is directed towards the direction that is opposite to the intended rotation direction RD of the rotor 6. The inner 20 and the outer 21 end edges together with the first 22 and second 23 side edges define a periphery of the blade segment 8.

The blade segment 8 comprises a body 24 having a front surface 25 to be directed towards the refining chamber 12 of the refiner 1 and a background surface 26 to be directed towards the hub 7 of the rotor 6. The front surface 25 of the blade segment body 24 is provided with blade bars 27 and blade grooves 28 which together provide the refining surface 9 of the blade segment 8. The blade bars 27 are intended to defiber and refine the material to be refined and the blade grooves 28 are intended to convey the material to be refined forward along the refining surface 9.

The blade segment 8 further comprises fastening holes 31, 32 intended to receive fastening means, like bolts, for fastening the blade segment 8 to the hub 7 of the rotor 6, or any supporting structures directly or via supporting means, like fixing rings 33. The blade segment 8 further comprises, at corners thereof, extensions or shoulder portions 34, 35, 36, 37 at which the blade segments 8 are in mutual sidewise contact to its neighboring blade segment 8 and thereby possibly supported to each other.

As the blade segment according to the solution disclosed herein is used in a through-fed refiner, it is provided with openings so as to allow the pulp feeding/discharge through a refining surface of the stator and/or the rotor. Herein the openings are arranged at least at one side edge of the blade segment in the middle portion of the longitudinal axis of the blade segment.

In the blade segment of 8 of FIG. 2, there is at the first side edge 22 of the blade segment 8 a continuous slit extending uninterruptedly between the shoulder portion 34 at the first end edge 20 of the blade segment 8 on the side of the first side edge 22 of the blade segment 8 and the shoulder portion 36 at the second end edge 21 of the blade segment 8 on the side of the first side edge 22 of the blade segment 8. This continuous, uninterrupted slit, or bay, is formed by two substantially straight long edge portions 22*a*, 22*b* being connected by a bevel 22*c*, wherein the direction of the long edge portions 22*a*, 22*b* are arranged to deviate, at the first side edge 22, from the direction of the longitudinal axis LA of the blade segment 8 towards the center part of the blade segment 8, i.e., to the same direction with respect to the direction of the longitudinal axis LA. The bevel 22*c*, in turn, is arranged to deviate, at the first side edge 22, from the direction of the longitudinal axis LA of the blade segment 8 away from the center part of the blade segment 8, i.e., to an opposite direction with respect to the longitudinal axis LA of the blade segment 8 than the long side edge portions 22*a*, 22*c*. Unlike as depicted in FIGS. 2 and 3 there could be one or more shoulder members along the side edge(s) by which the slit is interrupted here and there, thus providing indents between two shoulder members. For example, the bevels 22*c* could be extended to touch the neighboring segment.

In other words, the slit or bay at the first side edge 22 of the blade segment 8 is arranged such that the first side edge 22 does not form a completely straight line between the shoulder members 34, 36 at the inner end edge 20 and the outer end edge 21 but forms a longitudinal slit or bay with gentle zigzag or lightning shape edge. This slit or bay at the first side edge 22 of the blade segment 8 provides the opening 14 at the first side edge 22 of the blade segment 8. This opening 14 extends from the front surface 25 of the blade segment 24 up to the rear or background surface 26 of the blade segment body 24, thus extending through a whole thickness of the blade segment 8 or the blade segment body 24.

Furthermore, according to an embodiment of the blade segment 8, the blade segment 8 comprises substantially similar openings 14 on both side edges 22, 23 of the blade segment 8, as can be seen in FIG. 2, so that the opening at the second side edge 23 extends also from the second side edge 23 towards the opposite first side edge 22 such that the second side edge 23 does not also form a completely straight line between the inner end edge 20 and the outer end edge 21.

When assembling the above disclosed blade segments adjacent to each other so as to form a refining surface 5, 9 of the stator 3 or the rotor 6, a continuous longitudinal slit-like opening or discontinuous longitudinal slit-like openings are provided between the adjacent blade segments.

Figure 5:
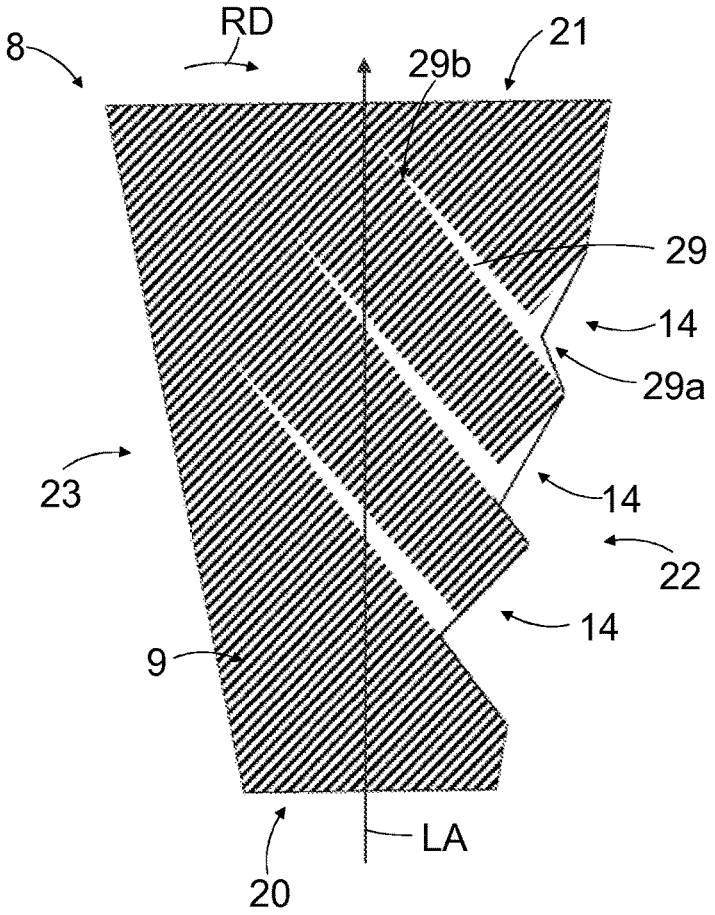
FIG. 5 is a schematic upper planar view of another blade segment.

FIG. 5 is a schematic upper planar view of another blade segment 8. In the blade segment 8 of FIG. 5, the first side edge 22 of the blade segment 8 comprises a number of openings 14, each having the form of an indent that extends from the first side edge 22 towards the opposite second side edge 23. In other words, there are openings 14 at the first side edge 22 of the blade segment 8 such that the first side edge 22 does not form a completely straight line between the inner end edge 20 and the outer end edge 21. The openings 14 extend from the front surface 25 of the blade segment body 24 up to the rear or background surface 26 of the blade segment body 24, the openings 14 thus extending through a whole thickness of the blade segment 8 or the blade segment body 24. Furthermore, the blade segment 8 may comprise one or more similar openings 14, i.e., indents, that extend from the second side edge 23 towards the opposite first side edge 22 such that the second side edge 23 does not also form a completely straight line between the inner end edge 20 and the outer end edge 21.

The blade segments 8 of FIGS. 3 and 5 or the refining surface 9 of the blade segments 8 of FIGS. 3 and 5 further comprise feed grooves 29. The feed groove 29 is arranged to extend from the opening 14 arranged in the first side edge 22 of the blade segment 8 towards at least one other edge of the blade segment 8, in the embodiments of FIGS. 3 and 5 towards the second side edge 23 of the blade segment 8, such that the feed groove 29 crosses the blade bars 28 and the blade grooves 29. The feed groove 29 has a first end 29*a* at the opening 14 and a second end 29*b* facing away from the opening 14. The opening 14 at the first side edge 22, i.e., at the leading side edge of the blade segment 8, and the feed groove 29 form a flow connection so that the material to be refined and supplied from the side of the background surface 26 of the blade segment 8 towards the front surface 25 of the blade segment 8 through the opening 14 enters into the feed groove 29 and flows along the feed groove 29 towards a central portion of the blade segment 8, thus feeding the material to be refined across the refining surface 9. At the same time, when the blade segment 8 rotates along with the rotor 6, forces affecting the material flowing in the feed groove 29 force the material away from the feed groove 29 into the blade grooves 28 remaining between the blade bars 27, thus distributing the material to be refined on the refining surface 9 of the blade segment 8.

The feed or supply of the material through the opening 14 in the side edge 22 of the blade segment 8 causes the material to flow on the refining surface 9 immediately at least partly along a peripheral direction of the refining surface 9, without a need to turn the flow of the supplied material from an axial or radial direction to an at least partly rotational motion along the peripheral direction of the refining surface as it takes place in the refiners wherein the feed or supply of the material takes place over the inner end edge of the blade segment. This reduces for example the energy consumption of the refiner by avoiding in the refining operation features that do not directly enhance efficiency of the refining.

In the embodiment of FIGS. 2 and 3 the feed groove 29 has its first end 29*a* at the slit or bay on the first side edge 22 of the blade segment 8 and the second end at the slit or bay or close to it on the second side edge 23 of the blade segment 8, i.e., the opposite side edge 23 of the blade segment 8. Specifically, the first end 29*a* of the feed groove 29 is located in the vicinity of a fixing ring, preferably just before or after the fixing ring at which the blade segment is to be assembled to the respective refining element. With the embodiment of FIGS. 2 and 3 the feeding grooves 29 enhance the pulp flow over the refining surface specifically in the vicinity of those areas of the slit where the fixing rings make interruption to the otherwise continuous slit preventing thus pulp from reaching freely the refining surface as well as around the bolt holes. Similarly, if the slit was discontinuous, interrupted by shoulder members, the first end 29*a* of the feed groove 29 would preferably locate in the vicinity of the shoulder and the groove 29 would extend over the bolt hole.

In order to increase the strength of the construction of the refining surface 9 at the feed groove 29 the blade bars 27 are interlaced at the feed groove 29. The interlacing of the blade bars 27 at the feed groove 29 means, referring in more detail to an embodiment of FIG. 4, that the blade bars 27 at one side of the feed groove 29 in respect of the longitudinal axis LA of the blade segment 8 are arranged to extend into the blade grooves 28 between the blade bars 27 at the opposite side of the feed groove 29 in respect of the longitudinal axis LA of the blade segment 8 and vice versa.

Figure 4:
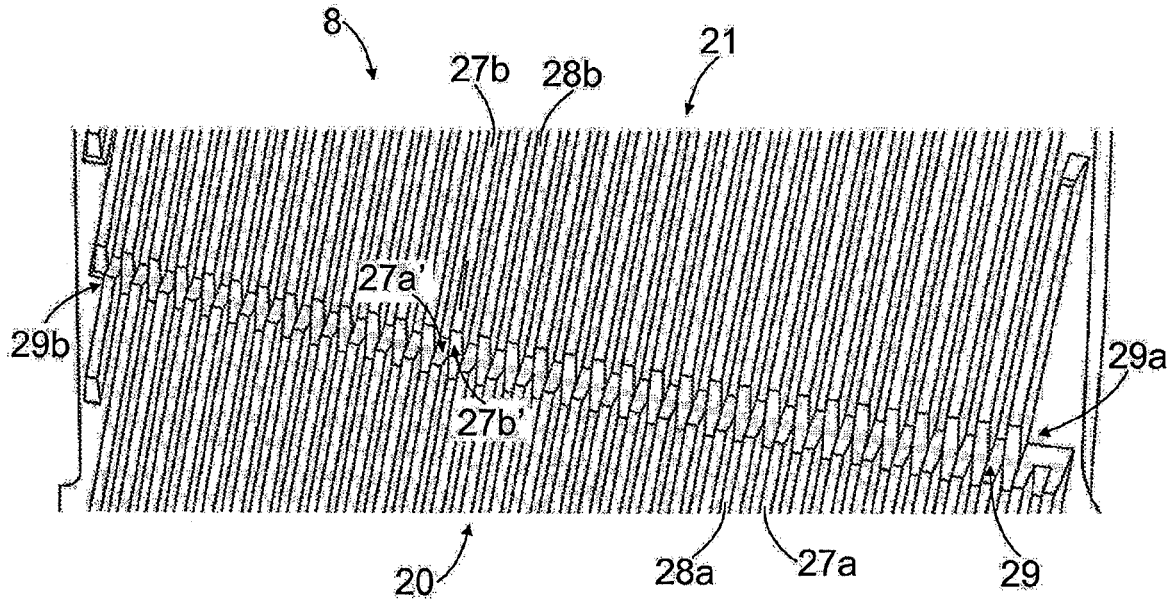
FIG. 4 is a schematic upper oblique view of a feed groove in a rotor blade segment.

An embodiment of the interlacing of the blade bars 27 is shown in more detail in FIG. 4, wherein FIG. 4 is a schematic upper oblique view of a feed groove 29 in the rotor blade segment 8. Similar interlacing of the blade bars 27 may also be applied also in the blade segment of FIG. 5, wherein, for enhancing the visibility of the path the feed groove, the blade bars 27 have not been drawn at the feed groove 29.

For describing the embodiment of FIG. 4 in more detail, it may be specified in respect of the feed groove 29 in the longitudinal direction of the blade segment 8 that there are first blade bars 27*a* extending from the direction of the inner end edge 20 of the blade segment 8 towards the feed groove 29 and up to the feed groove 29 as well as first blade grooves 28*a* between the first blade bars 27*a*. Furthermore, it may be specified in respect of the feed groove 29 in the longitudinal direction of the blade segment 8 that there are second blade bars 27*b* extending from the direction of the feed groove 29, i.e., from the feed groove 29, at least partly towards the outer end edge 21 of the blade segment 8 as well as second blade grooves 28*b* between the second blade bars 27*b*.

The first blade bar 27*a* has an end 27*a*' facing towards the outer end edge 21 of the blade segment 8, i.e., towards the second blade bars 27*b*, and extending into the second blade groove 28*b* between two neighboring second blade bars 27*b*. The second blade bar 27*b* has an end 27*b*' facing towards the inner end edge 20 of the blade segment, i.e., towards the first blade bars 27*a*, and extending into the first blade groove 28*a* between two neighboring first blade bars 27*a*.

The ends 27*a*', 27*b*' of the blade bars 27*a*, 27*b* in the embodiment of FIG. 4 are linearly downwards descending sloping surfaces that are arranged to partly interlace with each other such that the downwards descending sloping end 27*a*' of the first blade bar 27*a* partly extends into the second blade groove 28*b* between two neighboring or adjacent second blade bars 27*b* and the downwards descending sloping ends 27*b*' thereof, and correspondingly, the downwards descending sloping end 27*b*' of the second blade bar 27*b* partly extends into the first blade groove 28*a* between two neighboring or adjacent first blade bars 27*a* and the downwards descending sloping ends 27*a*' thereof. In the embodiment of FIG. 4 the oppositely directed ends 27*a*', 27*b*' of the first 27*a* and the second 27*b* blade bars are thus arranged to extend into the oppositely positioned blade grooves 28*a*, 28*b* between the oppositely positioned blade bars 27*a*, 27*b* by turns. The oppositely directed linearly downwards descending sloping ends 27*a*', 27*b*' of the first 27*a* and the second 27*b* blade bars form or provide an upwards opening V-shaped feed groove 29.

Deviating from the embodiment of FIG. 4, the ends 27*a*', 27*b*' of the blade bars 27*a*, 27*b*, instead of being linearly downwards descending sloping surfaces, could alternatively be for example in a convex manner or in a concave manner downwards descending sloping surfaces so as to form or provide an upwards opening feed groove 29 between the oppositely directed ends 27*a*', 27*b* of the first 27*a* and the second 27*b* blade bars. Thus, the feed groove 29 could have a U-shape profile or even a profile resembling a flying bird silhouette.

The interlaced blade bars 27, 27*a*, 27*b* at the feed groove 29 make a stronger blade bar configuration wherein the interlaced blade bars 27, 27*a*, 27*b* or the ends thereof support to each other at the feed groove 29, thereby preventing a buckling of the blade bars at the feed groove 29. The interlaced blade bars 27 at the feed groove 29 also equalize a cutting-edge length of the blade segment 8 when the blade bars wear down. Additionally, there are at the feed groove 29 more blade bar material to wear, thereby improving the lifetime of the blade segment.

The material to be refined is fed from the background surface 26 side of the blade segment 8 through the opening 14 into the feed groove 29 from the first end 29*a* of the feed groove 29. The material flows along the feed groove 29 from the first end 29*a* of the feed groove 29 towards the second end 29*b* of the feed groove 29 and, at the same time, the material is distributed from the feed groove 29 into the blade grooves 28 between the blade bars 27 and on top of the blade bars 27 into the refining chamber 12 between the stator 4 and rotor 8 blade elements.

According to an embodiment of the blade segment, a volume of the feed groove 29 is arranged to decrease along its path from the first end 29*a* of the feed groove 29*a* towards the second end 29*b*. The decreasing volume of the feed groove 29 refers to a decreasing cross-sectional area of the feed groove from the first end 29*a* of the feed groove 29 towards the second end 29 thereof. The decreasing volume of the feed groove 29 towards the second end thereof effectively forces the material to be refined and fed into the feed groove 29 to exit from the feed groove 29 into the blade grooves 28 between the blade bars 27 and on top of the blade bars 27 into the refining chamber 12 between the stator 4 and rotor 8 blade elements. The volume of the feed groove 29 may decrease from the first end 29*a* of the feed groove 29 towards the second end 29*b* of the feed groove 29 either substantially continuously from a preceding blade bar to a succeeding blade bar along the feed groove, or stepwise.

According to an embodiment of the blade segment, the decreasing volume of the feed groove in the longitudinal direction thereof is provided by arranging an angle of the downwards descending sloping ends of the interlaced blade bars relative to a normal of the refining surface at the feed groove to decrease along the feed groove from the first end of the feed groove towards the second end of the feed groove. An example of the embodiment like that is shown schematically in FIGS. 6*a* and 6*b*, wherein FIG. 6*a* shows schematically an interlacing of the blade bars 27*a*, 27*b* at a first end 29*a* of the feed groove 29 and FIG. 6*b* shows schematically an interlacing of the blade bars 27*a*, 27*b* at a second end 29*b* of the feed groove 29.

Figure 6A:
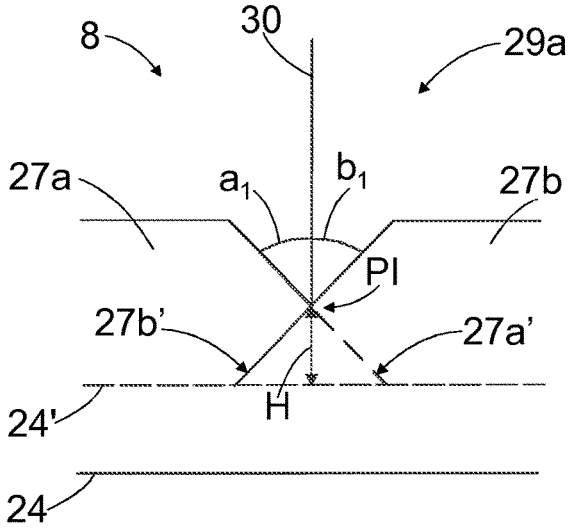
FIG. 6*a* shows schematically an interlacing of the blade bars at a first end of the feed groove.
Figure 6B:
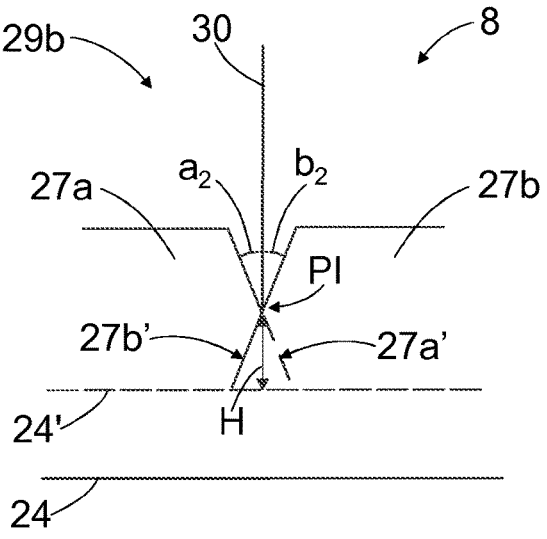
FIG. 6*b* shows schematically an interlacing of the blade bars at a second end of the feed groove.

FIGS. 6*a* and 6*b* show the first blade bar 27*a* and the end 27*a*' thereof, that lies partly behind the second blade bar 27*b* and the end 27*b*' thereof, as shown schematically by broken lines in FIGS. 6*a* and 6*b*. Further FIGS. 6*a* and 6*b* show the normal 30 of the refining surface 9 of the blade segment 8 at the feed groove 29, and, in FIG. 6*a* an angle $a_1$ between the normal 30 and the downwards descending end 27*a*' of the first blade bar 27*a* and an angle $b_1$ between the normal 30 and the downwards descending end 27*b*' of the second blade bar 27*b* at the first end 29*a* of the feed groove 29, as well as in FIG. 6*b* an angle a2 between the normal 30 and the downwards descending end 27*a*' of the first blade bar 27*a* and an angle $b_2$ between the normal 30 and the downwards descending end 27*b*' of the second blade bar 27*b* at the second end 29*b* of the feed groove 29. From FIGS. 6*a* and 6*b* it can be seen that the angle $a_1$ between the normal 30 and the downwards descending end 27*a*' of the first blade bar 27*a* at the first end 29*a* of the feed groove 29 is larger than the angle a2 between the normal 30 and the downwards descending end 27*a*' of the first blade bar 27*a* at the second end 29*b* of the feed groove 29, and similarly the angle $b_1$ between the normal 30 and the downwards descending end 27*b*' of the second blade bar 27*b* at the first end 29*a* of the feed groove 29 is larger than the angle $b_2$ between the normal 30 and the downwards descending end 27*b*' of the second blade bar 27*a* at the second end 29*b* of the feed groove 29. The cross-sectional area of the feed groove 29, and thereby the volume of the feed groove 29 decreases from the first end 29*a* of the feed groove 29 towards the second end 29*b* of the feed groove 29.

The embodiment of the feed groove 29 of FIGS. 6*a* and 6*b* has the effect of decelerating the flow of the material out of the feed groove, thereby allowing a substantially even flow of the material out of the feed groove by preventing burst-like escapes of the material out of the feed groove. At the same time, it increases the total cutting-edge length of the blade bars and therefore increases the total cutting-edge length of the complete refining surface. These features together with blade segments disclosed, i.e., with blade segments having supply of material over the side edge thereof and having therefore a remarkable flow of material in the peripheral direction thereof, result in improved refining treatment for the material to be refined.

In the embodiment of FIGS. 6*a* and 6*b* the normal 30 of the refilling surface 9 of the blade segment 8 at the feed groove 29 forms a center line of the feed groove 29 in such a way that the angle between the normal 30 and the downwards descending end 27*a*' of the first blade bar 27*a* and the angle between the normal 30 and the downwards descending end 27*b*' of the second blade bar 27*b* are substantially equal along the feed groove 29. Thereby, for example, the angles $a_1$ and $b_1$ are substantially equal relative to each other and the angles $a_2$ and $b_2$ are substantially equal relative to each other. However, the angle between the normal 30 and the downwards descending end 27*a*' of the first blade bar 27*a* and the angle between the normal 30 and the downwards descending end 27*b*' of the second blade bar 27*b* may be arranged to be different from each other. In this case, for example, the angles $a_1$ and $b_1$ could be arranged to be more or less different from each other and the angles $a_2$ and $b_2$ could be arranged to be more or less different from each other. In this case the flow of the material to be refined out from the feed groove 29 may be controlled in different ways at different portions along the feed groove 29 by intentionally forming the angle between the normal 30 and the downwards descending end 27*a*' of the first blade bar 27*a* and the angle between the normal 30 and the downwards descending end 27*b*' of the second blade bar 27*b* to be different from each other in different ways at different portions along the feed groove 29.

According to an embodiment of the blade segment, a vertical position of a plane of incidence of the downwards descending sloping ends of the interlaced blade bars is arranged to be substantially constant along the feed groove. An example of the embodiment like that is also shown schematically in FIGS. 6*a* and 6*b*, showing schematically the plane of incidence, indicated schematically by the reference sign PI, of the opposing downwards descending sloping ends 27*a*', 27*b*' of the interlaced blade bars 27*a*, 27*b*. The plane of incidence PI is arranged at a distance H from a top surface of the body 24 of the blade segment 8, the top surface of the body 24 of the blade segment 8 shown schematically by the broken line denoted with the reference sign 24'. When the distance H of the plane of incidence PI from the top surface 24' of the body 24 of the blade segment 8 is arranged to be substantially constant along the feed groove 29, it may be avoided the plane of incidence PI becoming to the top of the refining surface 9 of the blade segment before the end of the operating life of the blade segment 8.

According to an embodiment of the blade segment, the feed groove is arranged to cross the blade bars and the blade grooves at an angle. According to this embodiment, the feed groove 29 crosses the blade bars 27 and grooves 28 at an angle that is preferably of 90±45 degrees. The effect of this embodiment is a better distribution of the material to be refined from the feed groove 29 into the blade grooves 28 and onto the top surface of the blade bars 27, i.e., into the refining chamber 12.

According to an embodiment of the blade segment, the feed groove is curved along its direction of extension. According to this embodiment the second end 29*b* of the feed groove 29 is at a different position along the longitudinal axis LA of the blade segment than the first end 29*a* of the feed groove 29. In other words, the ends 29*a*, 29*b* of the feed groove do not locate on the same normal level to the longitudinal axis LA but the first end 29*a* may locate at one normal level, e.g., closer to the first end edge 20 of the blade segment 8, and the second end 29*b* at another normal level, i.e., farther away from the first end edge 20 of the blade segment 8. The advantageous effect of this embodiment is that the pulp flow is guided onto portions of the refining surface 9 not coinciding with the indents at the side edge(s) 22, 23 of the blade segment 8 or to areas of the refining surface 9 that might be less accessible to the pulp flow, like the areas around the fastening holes of the blade segment 8.

It will be obvious to a person skilled in the art that, as the technology advances, the inventive concept can be implemented in various ways. The invention and its embodiments are not limited to the examples described above but may vary within the scope of the claims.

The invention claimed is:

1. A blade segment for a refiner for refining fibrous material, the blade segment comprising:

a blade body having a front surface and a rear surface, defining a blade body thickness therebetween, the blade body bounded by a first end edge, a second end edge, a first side edge, and a second side edge opposite to the first side edge, the first side edge and the second side edge extending between the first end edge and the second end edge, wherein the front surface has blade bars and blade grooves which together form a refining surface of the blade segment;

portions of the blade body forming at least one opening extending through the blade body thickness from the front surface to the rear surface and adjoining at least at one of the first side edge and the second side edge when the segment is mounted within a refiner alongside another segment;

at least one feed groove on the refining surface, the feed groove extending from the at least one opening and crossing the blade bars and the blade grooves for feeding the material to be refined across the refining surface; and wherein the blade bars of the blade segment are interlaced at the feed groove.

2. The blade segment of claim 1 wherein the at least one opening extending through the blade body thickness is a continuous slit along the first side edge when an adjoining blade segment engages extensions arranged at a first corner of the blade segment where the first end edge joins the first side edge, and at a second corner of the blade segment where the second end edge joins the first side edge.

3. The blade segment of claim 1 wherein the opening is an indent in one of the first and second side edges and extending towards the other of the first side edge and the second side edge.

4. The blade segment of claim 1 wherein the blade bars have end parts which are interlaced at the feed groove, the end parts extending into opposed ones of the blade grooves, such that every other one of the end parts is directed into one of the blade grooves on an opposite side of the feed groove.

5. The blade segment of claim 4 wherein the end parts of the interlaced blade bars comprise downwards descending sloping ends arranged to form the upwardly opening feed groove.

6. The blade segment of claim 5 wherein the end parts of the interlaced blade bars are linearly downwards sloping ends arranged to form the feed groove as an upwards opening V-shaped groove.

7. The blade segment of claim 5 wherein a cross-sectional area of the feed groove decreases from the at least one opening, as the feed groove extends across the blade bars and the blade grooves.

8. The blade segment of claim 7 wherein an angle of the downwards descending sloping ends of the blade bars relative to a normal of the refining surface at the feed groove is arranged to decrease along the feed groove from a first end of the feed groove closest to the at least one opening towards a second end of the feed groove farther away from the at least one opening.

9. The blade segment of claim 7 wherein angles of the downwards descending sloping ends of the blade bars relative to a normal of the refining surface at the feed groove are equal.

10. The blade segment of claim 7 wherein a vertical position of a plane of incidence of the interlaced downwards descending sloping ends of the interlaced blade bars is substantially constant along the feed groove.

11. The blade segment of claim 1 wherein the feed groove is arranged to cross the blade bars and the blade grooves at an angle.

12. The blade segment of claim 11 wherein the feed groove is arranged to cross the blade bars and the blade grooves at an angle of 90±45 degrees.

13. The blade segment of claim 1 wherein the feed groove is curved along its direction of extension.

14. A refiner for refining fibrous material comprising a plurality of blade segments, the plurality of segments comprising:

a first blade segment mounted within the refiner alongside a second blade segment;

wherein the first segment comprises:

a blade body having a front surface and a rear surface defining a blade body thickness therebetween, the blade body bounded by a first end edge, a second end edge, a first side edge, and a second side edge opposite to the first side edge, the first side edge and the second side edge extending between the first end edge and the second end edge, wherein the front surface has blade bars and blade grooves which together form a refining surface of the first blade segment;

portions of the blade body forming a first opening alongside the second blade segment, the first opening extending through the blade body thickness from the front side to the rear side and adjoining the first side edge of the first blade segment;

at least one feed groove on the refining surface, the feed groove extending from the first opening and crossing the blade bars and the blade grooves for feeding the material to be refined across the refining surface;

wherein the blade bars and blade grooves extend from the first end edge toward the second end edge, and the blade bars alternate with blade grooves between the first side edge and the second side edge;

wherein the blade bars on one side of the feed groove transition into blade grooves on a second opposed side of the feed groove as they cross the feed groove, and the blade grooves on the one side of the feed groove transition into blade bars on the second opposed side of the feed groove; and wherein the blade bars outside the feed groove have a first height, and the blade grooves have a second height below the first height, and the blade bars are partly interlaced at the feed groove such that at a midline of the feed groove all the blade bars have a height between the first height and the second height.

15. The refiner of claim 14 wherein at the feed groove the blade bars comprise downwards descending sloping ends, and the blade grooves comprise upwards ascending sloping ends arranged to form the feed groove opening upwardly.

16. The refiner of claim 15 wherein at the feed groove the blade bars comprise linearly downwards descending sloping ends, and the blade grooves comprise linearly upwards ascending sloping ends arranged to form the feed groove as an upwards opening V-shaped groove.

17. The refiner of claim 14 wherein a cross-sectional area of the feed groove decreases from the opening as the feed groove extends across the blade bars and the blade grooves.

18. The refiner of claim 14 wherein the blade bars have end parts which comprise downwards descending sloping ends which extend across the midline, and wherein the end parts of the blade bars on the one side of the feed groove are joined to opposed end parts of the blade bars on the second opposed side of the feed groove.

19. A blade segment for a refiner for refining fibrous material, the blade segment comprising:

a blade body having a front surface and a rear surface defining a blade body thickness therebetween, wherein the blade body is bounded by a first end edge, a second end edge, a first side edge and a second side edge opposite to the first side edge, the first side edge and the second side edge extending between the first end edge and the second end edge, wherein the front surface has blade bars and blade grooves which together form a refining surface of the blade segment;

portions of the blade body forming, when positioned alongside a second blade segment, a first opening extending through the blade body thickness from the front side to the rear side and adjoining at least one of the first side edge and the second side edge;

at least one feed groove on the refining surface, the feed groove extending from the first opening and crossing the blade bars and the blade grooves for feeding the material to be refined across the refining surface; and wherein the blade bars transition into the blade grooves and the blade grooves transition into the blade bars as said blade bars and said blade grooves cross the feed groove.

20. The blade segment of claim 19 wherein the blade bars have end parts which comprise downwards descending sloping ends which extend across a midline of the feed groove, and wherein the end parts of the blade bars on one side of the feed groove are joined to opposed end parts of the blade bars on a second opposed side of the feed groove.

* * * * *